US006109015A

United States Patent [19]

Roark et al.

[11] Patent Number: 6,109,015

[45] Date of Patent: Aug. 29, 2000

[54] PROCESS FOR MAKING POLY (TRIMETHYLENE TEREPHTHALATE) YARN

[75] Inventors: Milton K. Roark, Bristol; Matthew B. Studholme, Abingdon, both of Va.

[73] Assignee: Prisma Fibers, Inc., Bristol, Va.

[21] Appl. No.: 09/111,593

[22] Filed: Jul. 7, 1998

Related U.S. Application Data

[60] Provisional application No. 60/081,194, Apr. 9, 1998.

[51] Int. Cl.[7] ..... D01H 13/26

[52] U.S. Cl. ..... 57/290; 57/286; 57/295; 57/351; 57/908; 264/103; 264/168

[58] Field of Search ..... 57/295, 290, 286, 57/908, 351; 264/103, 168, 178 F, 210.2, 210.3, 211.14, 211.15

[56] References Cited

U.S. PATENT DOCUMENTS

| | | | |
|---|---|---|---|
| 3,681,188 | 8/1972 | Harris | 161/173 |
| 5,645,782 | 7/1997 | Howell et al. | 264/103 |
| 5,662,980 | 9/1997 | Howell et al. | 428/88 |
| 5,939,166 | 8/1999 | Cheng et al. | 428/92 |

FOREIGN PATENT DOCUMENTS

| | | |
|---|---|---|
| 0745711 | 12/1996 | European Pat. Off. . |
| 1254826 | 11/1971 | United Kingdom . |

OTHER PUBLICATIONS

H. Brody, *Synthetic Fibre Materials*, Longman, 1994, pp. 134–140.

M. Tant et al., "Physical Aging Studies of Semicrystalline Poly(ethylene Terephthalate)" in J. of Applied Science, vol. 26, 1981, pp. 2813–2825.

*Primary Examiner*—William Stryjewski
*Attorney, Agent, or Firm*—Dykema Gossett PLLC

[57] ABSTRACT

In a method of producing poly(trimethylene terephthalate) yarn from PTT chip which has been extruded through a spinneret into filaments and coated, the coated filaments are passed between an unheated feed roll and a tension roll to tension them without causing permanent stretching, and then are passed from the tension roll to a heated draw roll to draw the filaments in a single draw step to a draw ratio of 1.25 to 4.0 and to heat them to a temperature between their glass transition temperature and their crystallization temperature.

10 Claims, 2 Drawing Sheets

PROCESS FOR MAKING POLY (TRIMETHYLENE TEREPHTHALATE) YARN

This application claims the benefit of the filing date of U.S. Provisional Application Serial No. 60/081,194, filed Apr. 9, 1998.

BACKGROUND OF THE INVENTION

1. Field of the Invention

The present invention relates to poly(trimethylene terephthalate) (PTT) yarn, and more particularly to a method of producing bulked continuous filament PTT yarn useful in the fabrication of carpets and pile fabrics.

2. The Prior Art

It is well known to use bulked continuous filament PTT yarns in fabricating carpets and pile fabrics due to the natural stain resistance displayed by PTT. As disclosed in U.S. Pat. No. 5,645,782, such yarns are conventionally produced by a single spin-draw-texturing procedure wherein molten PTT polymer is extruded through a spinneret to form PTT filaments, the filaments are cooled by means of air flowing perpendicularly to the filaments and then coated with a spin finish, the coated filaments are then heated and drawn between a pair of feed rolls and a pair of draw rolls, thereafter textured and finally wound up. However, since the filaments are drawn and textured immediately after being spun, the PTT filaments cannot be combined with other filaments, e.g., so as to provide a multicomponent finished product. In this regard, it is often desirable to combine PTT yarns with natural, delustered or colored yarns, antistatic yarns, marker, signature or other novelty yarns, or yarns for producing antimicrobial, flame retardancy, stabilization, or other functional enhancements.

Conventional two stage processing routes involve melt spinning an undrawn yarn in a first discrete step and then drawing and texturing the yarn in a second discrete step. However, PTT yarn physically ages. This aging phenomenon occurs at ambient temperature with any polymer that is essentially amorphous, or which has been quenched from molten state into an essentially amorphous state at a temperature that is below and close to the glass temperature of the polymer. This aging phenomenon causes essentially amorphous PTT yarn to become extremely brittle within a few hours after spinning, such that subsequent handling and processing results in filament breakage and damage.

EP 0 745 711 A1 discloses a process for forming bulked continuous filament PTT yarn wherein PTT polymer is melt spun through a spinneret into filaments, cooled with cold air, converged into a yarn, coated with a spin finish, drawn a first time between a feed roll and a first draw roll to achieve a draw ratio of 1.05 to 2, then drawn a second time between the first draw roll and a second draw roll to achieve a draw ratio of at least 2.2 times that of the first draw ratio, and then wound up. The drawn yarn can be textured before or after being wound up. Carpets fabricated in accordance with this invention have reasonably good stain resistance; however, their wear characteristics are only fair.

The present invention is directed to a process for producing bulked continuous filament PTT yarns wherein the yarns can be combined with other types of yarns in a two stage process, and wherein carpets made from such yarns have unexpectedly improved wear resistance.

SUMMARY OF THE INVENTION

According to this invention filaments of melt-spun PTT polymer are cooled and coated with a spin finish and then drawn in a first step between an unheated feed roll and a tension roll rotated at a speed such that the PTT filaments are tensioned but not permanently stretched, and in a second step between the tension roll and a draw roller rotated at a speed such that the PTT filaments are drawn to a draw ratio of 1.25 to 4.0. The drawn filaments are then wound up on a winding device and thereafter textured using a mechanical crimp texturing unit where a single end of a drawn filament bundle can be textured or multiple ends of a drawn filament bundle can be cotextured.

It has been surprisingly found that carpet produced from the yarn of the present invention has superior wear resistance as compared to PTT yarn produced by conventional two-step processes.

More specifically, the inventive method includes the steps of:

(a) feeding PTT polymer chip having an intrinsic viscosity, or IV, of between 0.7 and 1.2 and a moisture content of less than 100 ppm, together with any additives totalling less than 300 ppm, to a melt extrusion system wherein the input is melted, mixed, homogenized and extruded at a temperature from 240 to 270° C. through a filtration system to a spinneret to form filaments, (b) cooling the filaments in a quench chamber by means of air flowing across the surface of the filaments at a velocity from 0.1 to 1.0 m/sec, optionally employing a forced flow exhaust system close to the spinneret to remove volatiles from the spinning environment, (c) coating the filaments with a spin finish, (d) tensioning the yarn between two rolls, or set of rolls, so as to tension the yarn but not permanently stretch the yarn, the first roll or set of rolls being not heated and the second roll or set of rolls being heated to give a yarn temperature greater than the glass transition temperature of the filaments but less than the crystallization temperature, (e) drawing the filaments between the second roll, or set of rolls, and a third roll, or set of rolls, heated to give a yarn temperature of between 100 and 200° C., the draw ratio being 1.25 and 4.0, and (f) winding the drawn yarn with a winding device.

The denier of the individual drawn filament bundle is preferably between 150 and 800. The texturing of the drawn filaments via a separate process occurs in a mechanical crimp texturing unit wherein a single end of a drawn filament bundle can be textured, or multiple ends of a drawn filament bundle are co-textured. The denier of the textured yarn can be up to 7000.

The spin finishing of step (c) can be alternately or additionally applied prior to the texturing process, and the textured filaments can be entangled before being wound up. Such entanglement can be in single or multiple stages to create certain desired styling effects.

The invention will be better understood by reference to the attached drawings, taken in conjunction with the following discussion.

DETAILED DESCRIPTION OF THE DRAWINGS

Figure 1:
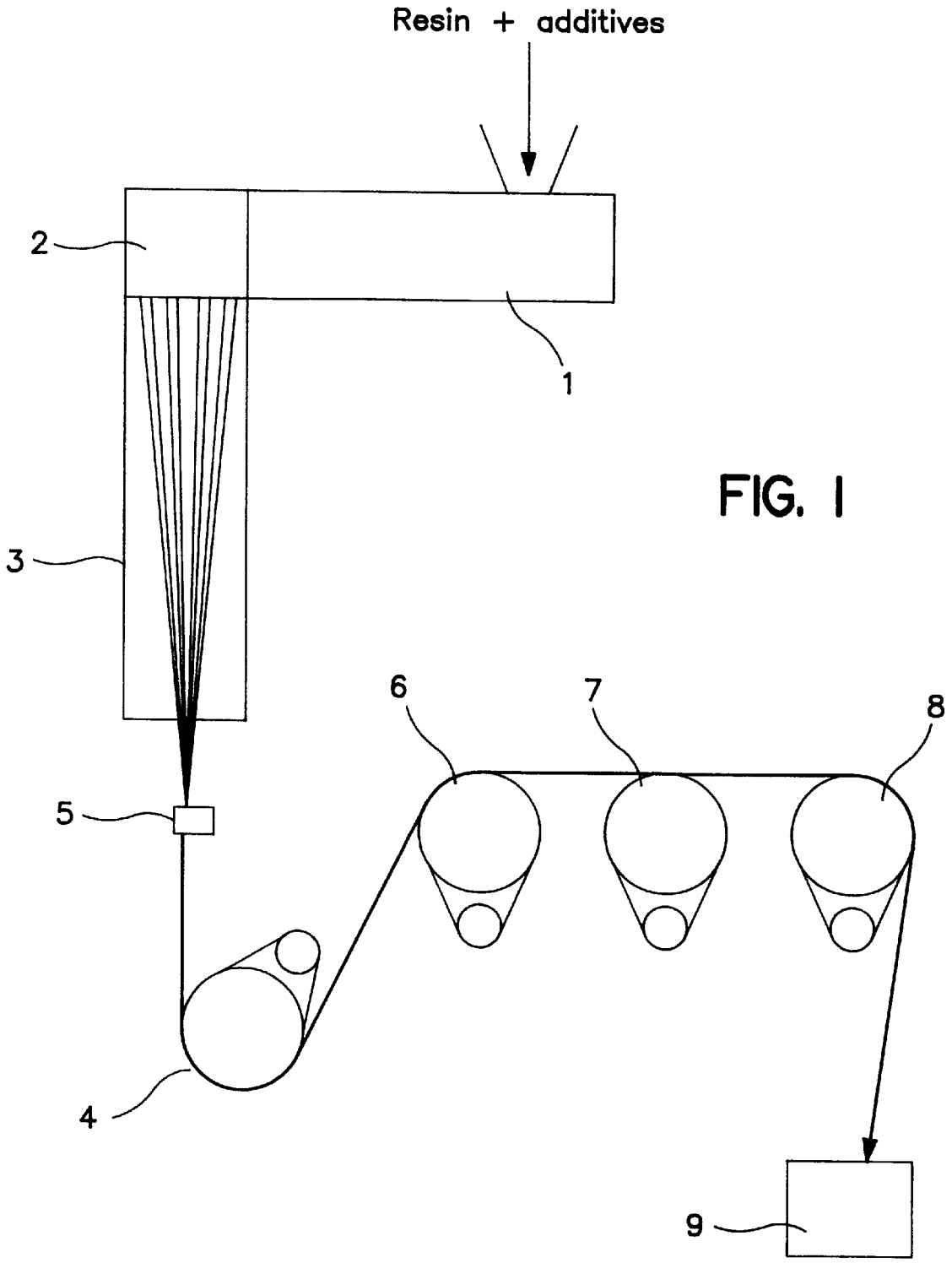
FIG. 1 schematically depicts the steps of producing a PTT yarn in accordance with a preferred embodiment of the present invention, and FIG. 2 schematically depicts the steps of texturing the drawn yarn.

As indicated in FIG. 1, according to the present invention PTT pellet resin, together with optional additives, is fed into the throat of an extrusion device 1 where the input material is heated and mixed, and pumped through a spinneret 2. The continuous PTT filaments emerging from the spinneret are pulled by an unheated feed roller 4 through a quench chamber 3 and a spin finish applicator 5. After passing around feed roller 4, the PTT filaments extend to a heated roller 6, a heated draw roller 7, a fourth roller 8 and a winding device 9.

Mixing devices can be incorporated in the extrusion system to assist in the production of a homogenized melt. The temperatures of the heating devices of the extrusion system are adjusted to give a melt temperature of between 240° C. and 270° C., with a preferable melt temperature of 245°–260° C. Filament cross-sections are preferably trilobal, although other types of cross-sections may be suitably used. A forced flow exhaust system is located close to the spinneret face to remove any volatiles generated from the working environment. This exhaust system may cause some cooling of the spun filaments. Further cooling of the spun filaments occurs in the quench chamber containing chilled air at a temperature of between 5° and 20° C., and preferably between 10° and 15° C. Spin finish is applied using a suitable device, such as a kiss roll or a metered finish applicator. The primary purpose of the spin finish is to promote bundle cohesion and reduce surface friction so as to assist in any further yarn processing steps such as texturing and yarn twisting. Functional additives may be incorporated into the spin finish, such as stain resistance additives and anti-soiling additives including fluorochemicals.

The yarn denier is fed around a first unheated roll to control yarn denier. The yarn is then fed to a second roll which is heated to a temperature of between 45° C. and 150° C. The actual roll temperature used is dependent on the yarn contact time on the roll. The contact time/roll temperature used should be adjusted so that crystallization of the PTT polymer is not significantly induced. Between the first and second roll the yarn is tensioned, but not so that the yarn is permanently stretched. For example, the second roll can be rotated at a 2% greater speed than the first roll. The yarn is then fed to a third roll that is heated to give a yarn temperature above the glass transition temperature and preferably between 100° C. and 200° C. The measured glass transition temperature of the yarn will depend on the method used to determine it. The method used to determine the glass transition temperature in this invention is by use of differential scanning calorimetry at a heating rate of 10° C./minute. The glass transition temperature is the midpoint of the inflexion relating to the glass transition of the differential scanning calorimetry curve. The actual roll temperature used shall again depend on the yarn contact time on the roll. The speed of the third roll will be set faster than that of the second roll to give a yarn draw ratio between the second and third rolls of at least 1.25, but lower than that required to break the yarn under the conditions used. During the drawing and heating process the yarn crystallizes, increases in tenacity and reduces in % elongation, resulting in a substantial reduction in the physical aging phenomenon. The drawn yarn is wound up using a suitable winding device. The denier of the drawn yarn is preferably in the range of 150 to 800 with a tenacity of at least 2.5 g/denier and a % elongation of less than 60%. The drawn yarn denier is selected based on the number and size of the filament bundles needed to give the desired textured yarn denier and filament count.

Figure 2:
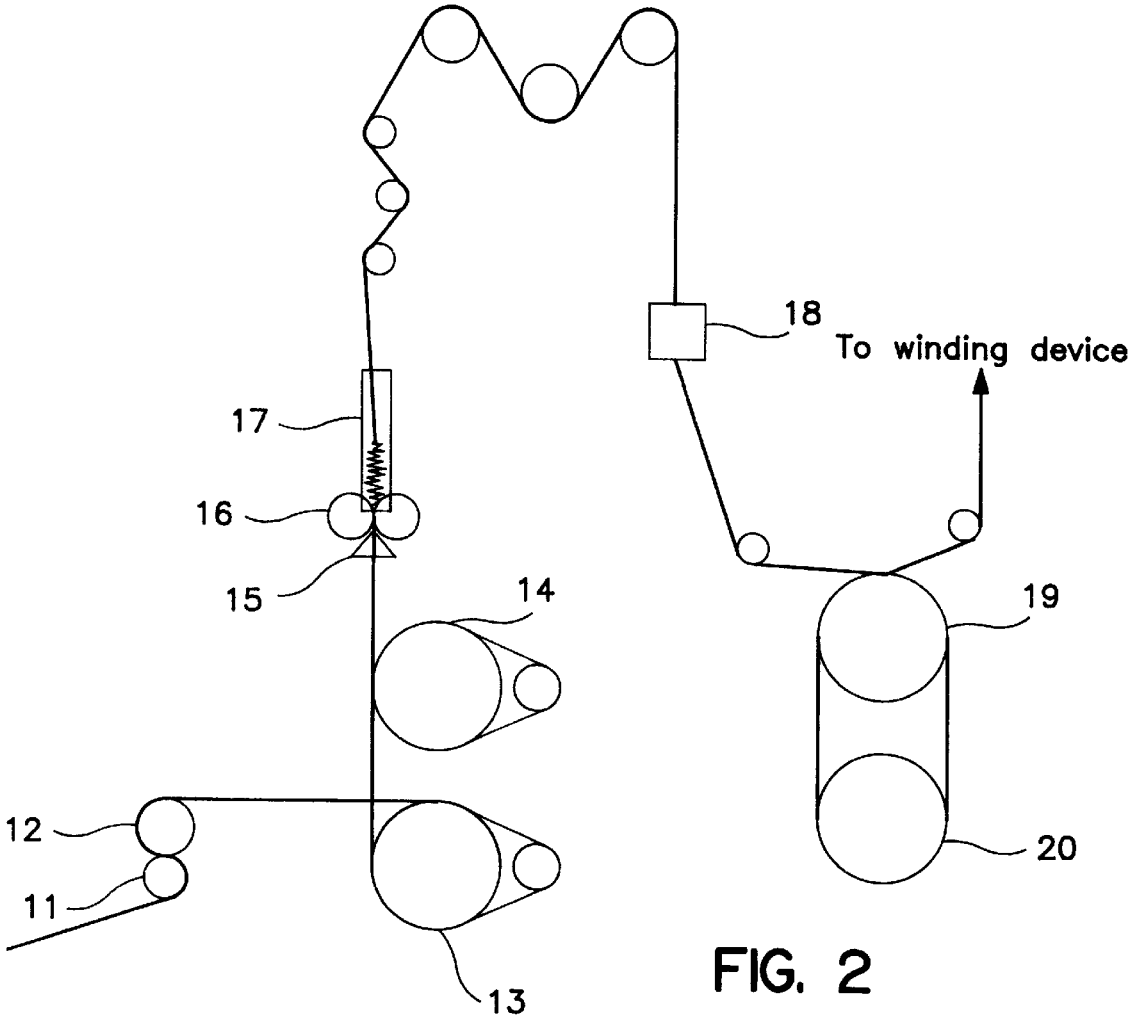

The drawn yarn produced is then textured using a mechanical crimp texturing unit to give a random 2-dimensional rectilinear crimp familiar to those ordinarily skilled in the art, without additional drawing of the yarn. An example of a suitable unit is illustrated in FIG. 2. The yarn is fed around a pair of pretension rolls 11,12 to a heated roll 13 prior to being fed to another heated roll 14 under sufficient tension to control the feed rate but not enough to draw the yarn. The heated yarn is fed through an infeed guide 15 and between a set of crimp rolls 16. The yarn is forced into the stuffing chamber and then pulled out of the stuffing chamber and passed around a set of stationary or rotating guides. The textured yarn is entangled through an entangler unit 18 and around a set of unheated rolls 19,20 before being wound up by a suitable winding device. Heating of the yarn is necessary immediately prior to crimping, for example by feeding the yarn over one or more heated rolls, in order to attain crimp memory once it is crimped. The yarn temperature prior to crimping should be greater than the glass transition temperature of the polymer but less than 220° C., but preferably between 100° and 200° C. The actual yarn temperature used will depend on the yarn contact time. A single drawn filament yarn may be textured or two or more drawn yarn bundles maybe cotextured. The textured yarn may be entangled together. If multiple drawn yarns are cotextured, then these yarns may be different colors or one or more of the components may be suitably functionalized to give the desired textured end product performance.

In addition to reduced yarn and filament breakage during texturing, faster texturing processing speeds can be obtained using the process of this invention. Using a conventional 2-step spin-draw-texture process, that is producing an undrawn yarn and a one-step drawing and texturing the undrawn yarn via a second discrete step, achieving texturing speeds of greater than 400 m/minute is difficult. Using the process of this invention, texturing speeds of at least 800 m/minute can easily be achieved.

A set of rolls can be used in place of a single roll at any stage in the present invention.

The textured yarn is ideally used to produce a carpet using methods of manufacture known to those ordinarily skilled in the art, including tufting, weaving, bonding, needle-loom and knitting. Pages 134 to 140 of "Synthetic Fiber Materials," edited by H. Brody, published by Longman, 1994, gives detailed descriptions of these methods, the disclosure of which is incorporated by reference.

The following test methods apply to this invention:

Intrinsic Viscosity: 0.2990–0.3010 g of the sample is dissolved in 25 $cm^3$ of 99+% dichlororacetic acid obtained from Aldrich Chemical Co., Inc. The viscosity of the solution is measured using a Cannon-Ubbelohde type 100 viscometer at 34.80°–35.2° C.

% Shrinkage: A 15 gram weight is hung on the bottom of a skein of yarn consisting of 7 wraps of a 1 meter circumference denier reel. The yarn skein with the weight is hung inside an oven at 118° C.–122° C. for 2 minutes. The % shrinkage is the amount that the yarn skein contracts by after it is removed from the oven.

Carpet Wear Testing: Tufted carpet was tested per ASTM Test Method D5252-92 to 50,000 revolutions at 70° F. and 50% R.H. An Electrolux Upright Vacuum Cleaner model LXE was used to vacuum the carpet after the test and before grading. The carpet was not vacuumed after every 2000 revolutions as detailed in the ASTM Test Method. The worn carpet samples were graded using the Carpet and Rug Institute Reference Scale A. This scale consists of four photographs numbered from 1 to 4 showing gradually increasing degrees of wear, appearance deterioration or matting. A grade of 1 indicates a badly worn sample. A grade of 5 indicates that no wear has occurred. If the tested sample falls between two photographs, then a half grade is given. For example, if the degree of wear falls between photographs 3 and 4 then a grade of 3.5 is given. This test is known by those of ordinary skill in the art to simulate human foot traffic. One revolution of the test drum is considered to be equivalent to 8–12 foot traffics.

The invention is illustrated by the following non-limiting examples.

EXAMPLE 1

Comparative Example Using a Conventional Two-Step Process

A PTT resin with an intrinsic viscosity of 0.9 was dried to less than 50 ppm moisture content and was spun using a single screw extrusion system of design known to those of ordinary skill in the art. The molten polymer was pumped to a spin pack of setpoint temperature of 257° C. containing melt filtration media and then to a 70 hole spinneret with trilobal shaped holes. An exhaust system was located in close proximity to the spinneret to remove any volatiles from the work environment. The 70 filaments were cooled by chilled air at 13° C. and at a velocity of 0.6 m/sec before being separated into two filament bundles and spin finish was applied. The undrawn yarn was wound up on a Leesona 959 winder to produce a denier of 1850/30Y. The tenacity within 15 minutes of the yarn being produced was 0.6 g/denier and the % elongation was 450%. After 2 hours of conditioning at 70° F. and 50% RH, the yarn tenacity had dropped to 0.4 g/denier and the % elongation was 4%. 4 ends of the yarn were mechanically crimped using one stage drawing at a draw ratio of 3.2. The yarn was drawn between two heated rolls, the first one set at 66° C. and the second roll at 150° C. The maximum take-up speed that could be achieved was 400 m/minute. During the crimping process frequent yarn breakage were experienced and an unacceptable level of filament breakages occurred. A yarn denier of 2710 was obtained. The tenacity of the textured yarn was 1.7 g/denier with a % elongation at break of 53%. The textured yarn was tufted into 1/10 inch gauge, 3/16 inch pile height level loop carpet having 20 oz. of yarn per sq. yd. of carpet. The tufted carpet was backed with a standard latex backing. The carpet was subjected to the wear test described above. The grade of the worn carpet was 2.5.

EXAMPLE 2

A PTT resin with an intrinsic viscosity of 0.9 was dried to less than 50 ppm moisture content and was spun using a single screw extrusion system of design known to those of ordinary skill in the art. The molten polymer was pumped to a spin pack of a setpoint temperature of 243° C. containing melt filtration media to a 34 hole spinneret with trilobal shaped holes. The melt temperature of the polymer prior to the spin pack was 250° C. An exhaust system was located in close proximity to the spinneret to remove any volatiles from the work environment. The molten filaments emerging from the die were cooled with air at 16° C. of velocity of 0.6 m/sec. A spin finish was applied to the cooled filaments before being fed to unheated roll 4 (see FIG. 1). The yarn was fed to roll 6 set at 54° C., run at a speed 1% greater than that of roll 4, before being drawn at a 3.33 draw ratio to roll 7 set at a temperature of 149° F. The yarn was then wound up using a tension-driven Leesona 959 winder. The drawn yarn had a denier of 714 with a tenacity of 2.7 g/denier and a % elongation at break of 49%. No degradation of properties occurred in the yarn after conditioning the yarn for 24 hours at 70° F. and 50% RH.

EXAMPLE 3

Yarn was spun per Example 2 except the denier was also adjusted to 590/34Y by changing the spin pump speed. The drawn yarn tenacity was 2.7 g/denier with a % elongation of 39%. No degradation of properties occurred in the yarn after conditioning the yarn for 24 ours at 70° F. and 50% RH. 4 ends of this yarn were co-textured together via a mechanical crimping process without further drawing to produce a 2-dimensional rectilinear crimp with a denier of 2360. No yarn or filament breakages occurred during the yarn crimping process. The textured yarn tenacity was 1.5 g/denier and % elongation was 46%.

EXAMPLE 4

A carbon black pigment dispersion and a titanium dioxide pigment dispersion were further dispersed together in a PTT resin with an intrinsic viscosity of 0.9 that had been dried to less than 50 ppm on a twin-screw extruder. The two pigment dispersions were produced by dispersing the pigments in a PTT resin also of an intrinsic viscosity of 0.9. The compound produced was dried to less than 50 ppm moisture content and spun using a single screw extrusion system of design known to those of ordinary skill in the art. The molten polymer was pumped to a spin pack of a setpoint temperature of 254° C. containing melt filtration media to a 34 hole spinneret with trilobal shaped holes. The melt temperature of the polymer prior to the spin pack was 259° C. An exhaust system was located in close proximity to the spinneret to remove any volatiles from the work environment. The molten filaments emerging from the die were cooled with air at 16° C. of velocity of 0.6 m/sec. A spin finish was applied to the cooled filaments before being fed to unheated roll 4. The yarn was fed to roll 6 set at 54° C. and set at a speed 1% greater than roll 7 before being drawn at a 3.2 draw ratio to roll 7 set at a temperature of 149° C. The drawn yarn had a denier of 340 and a tenacity of 2.9 g/denier with a % elongation of 44%.

EXAMPLE 5

8 drawn yarn ends produced per Example 4 were co-textured using a mechanical crimping process familiar to those ordinarily skilled in the art without further drawing. The yarn was tensioned around two heated rolls prior to crimping. The first roll was heated to 68° C. and the second roll was heated to 107° C. The yarn was heated by feeding it around two heated rolls prior to crimping. The first roll was heated to 68° C. and the second roll was heated to 107° C. The processing speed was 800 m/minute. The textured yarn ends entangled together before being wound up. The denier of the textured yarn was 3000. The yarn had a tenacity of 2.0 g/denier, a % elongation of 49% and a % shrinkage of 5%.

EXAMPLE 6

2 drawn yarn ends produced per Example 4 were co-textured using a mechanical crimping process similar to that used in Example 5 with the yarn heated to the same temperatures in the manner described in Example 5. The denier of the textured yarn was 785. No yarn or filament breakages occurred during the yarn crimping process. The textured yarn tenacity was 1.7 g/denier and the % elongation was 39%.

EXAMPLE 7

A white pigment that had been dispersed in a PA6 carrier to form a masterbatch concentrate was further dispersed in a PTT resin with an intrinsic viscosity of 0.9 that had been dried to less than 50 ppm on a twin-screw extruder. The white pigment masterbatch concentrate contained a copper iodide/potassium iodide based stabilizer. The compound produced was dried to less than 50 ppm moisture content and spun using a single screw extrusion system of design known to those of ordinary skill in the art. The molten polymer was pumped to a spin pack of a setpoint temperature of 254° C. containing 20 micron melt filtration media to a 30 hole spinneret with trilobal shaped holes. The melt temperature of the polymer prior to the spin pack was 258° C. An exhaust system was located in close proximity to the spinneret to remove any volatiles from the work environment. The molten filaments emerging from the die were cooled with air at 16° C. of velocity of 0.6 m/sec. A spin finish was applied to the cooled filaments before being fed to unheated roll 4. The yarn was fed to roll 6 set at 66° C. and set at a speed 1% greater than roll 4 before being drawn at a 3.2 draw ratio to roll 7 set at a temperature of 121° C. The yarn was relaxed before winding the yarn up on a tube. The drawn yarn had a denier of 300 and a tenacity of 2.8 g/denier with a % elongation of 40%. The yarn was spun and drawn continuously for a period of at least 18 hours without filament breakage or process interruption.

EXAMPLE 8

A bronze-colored solution-dyed yarn was produced in a similar manner to Example 7 of similar denier, filament and cross-section shape. The pigments in the formulated bronze color were predispersed in a PA6 carrier prior to producing the compound for spinning. The formulation did not contain a copper iodide/potassium iodide based stabilizer. The drawn yarn had a tenacity of 2.8 g/denier with a % elongation of 38%.

EXAMPLE 9

A black solution-dyed yarn was produced in a similar manner to Example 7 of similar denier, filament and cross-section shape. The pigments in the formulated color were predispersed in a PA6 carrier prior to producing the compound for spinning. The formulation did not contain a copper iodide/potassium iodide based stabilizer. The drawn yarn had a tenacity of 2.8 g/denier with a % elongation of 43%.

EXAMPLE 10

A blue solution-dyed yarn was produced in a similar manner to Example 7 of similar denier, filament and cross-section shape. The pigments in the formulated color were predispersed in a PTT carrier prior to producing the compound for spinning. The formulation did not contain a copper iodide/potassium iodide based stabilizer. The drawn yarn had a tenacity of 2.8 g/denier with a % elongation of 42%.

EXAMPLE 11

Two ends of the drawn yarn produced in Example 9 were co-textured together using a mechanical crimping unit without further drawing similar to that used in Example 5 with the yarn heated to the same temperatures in the manner described in Example 5. No yarn or filament breakages occurred during the yarn crimping process. The textured yarn produced had a denier of 716 with a tenacity of 1.4 g/denier and % elongation of 32%.

EXAMPLE 12

Eight drawn yarn ends, two from each of Examples 7 to 10, were co-textured together using a mechanical crimping unit without further drawing similar to that used in Example 5, with the yarn heated to the same temperatures in the manner described in Example 5. No yarn or filament breakage occurred during the yarn crimping process. The multicolored textured yarn produced had a denier of 2780 with a tenacity of 1.8 g/denier and a % elongation of 50%. The textured yarn was tufted into 1/10 inch gauge, 3/16 inch pile height level loop carpet having 20 oz. of yarn per sq. yd. of carpet. The tufted carpet was backed with a standard latex backing. The carpet was subjected to the wear test described above. The grade of the worn carpet was 4.

EXAMPLE 13

Eight ends of yarn produced in Example 7 were co-textured together using a mechanical crimping unit without further drawing similar to that used in Example 5 with the yarn heated to the same temperatures in the manner described in Example 5. No yarn or filament breakage occurred during the yarn crimping process. The textured yarn product had a denier of 2645 with a tenacity of 2.0 g/denier and a % elongation at break of 44%. Carpet was made from the yarn in a manner similar to Example 12. The carpet was subjected to the wear test described above. The grade of the worn carpet was 4.

EXAMPLE 14

This example demonstrates the effect of two-stage drawing on yarn performance.

An off-white formulated color concentrate with a PTT carrier was produced on a twin-screw extruder. The off-white color concentrate was letdown at the desired level in a PTT resin with an intrinsic viscosity of 0.9, also in a twin-screw extruder. Both the color concentrate and the PTT resin had been dried to a water content of less than 50 ppm. The compound produced was then further dried to less than 50 ppm water content and spun using a single screw extrusion system of a design known to those ordinarily skilled in the art. The molten polymer was pumped to a spin pack with a setpoint temperature of 254° C. containing melt filtration media and a 30 hole spinneret with trilobal shaped holes. The melt temperature of the polymer prior to the spin pack was 251° C. An exhaust system was located in close proximity to the spinneret to remove any volatiles from the work environment. The molten filaments were cooled in a quench stack with air at 16° C. of velocity of 0.6 m/sec. A spin finish was applied to the cooled filaments before being fed to an unheated roll 4. The yarn was fed to a second roll 6 set at 65° C. run at a speed 10% greater than that of roll 4. The yarn was fed to a third roll 7 set at 121° C. at a speed 309% faster than roll 6. The drawn yarn was wound up on a tube. The yarn had a denier of 560/30Y, with a tenacity of 3.0 g/denier and a % elongation at break of 39%.

Four drawn yarn ends were co-textured together using a mechanical crimping unit without further drawing. The yarn was tensioned and heated around two heated rolls prior to crimping. The first roll was set at a temperature of 66° C. and the second roll was set at a temperature of 238° C., with a speed difference between roll 1 and roll 2 of 1%. The textured yarn ends were entangled together before being wound up. The denier of the textured yarn was 2560 with a tenacity of 2.1 g/denier and a % elongation at break of 45%. The textured yarn was tufted into 1/10 inch gauge, 3/16 inch pile height level loop construction carpet having a face yarn weight of approximately 24 oz. per sq. yd. of carpet. The tufted carpet was backed with a standard latex backing. The carpet was subjected to the wear test described above. The grade of the worn carpet was 3.0. This was lower than expected, considering the high denier per filament of the yarn and heavy carpet weight.

We claim:

1. A method of producing a poly(trimethylene terephthalate) yarn which resists physical aging and is useful in the fabrication of carpeting and pile fabrics which comprises the steps of:

(a) feeding poly(trimethylene) terephthalate polymer chip to a melt extrusion apparatus wherein said polymer is melted, mixed and extruded through a spinneret to form filaments, (b) cooling said filaments formed in step (a) using air flowing perpendicularly to the movement of said filaments, (c) coating the cooled filaments provided in step (b) to form coated filaments, (d) passing said coated filaments between an unheated feed roll and a tension roll so as to tension said coated filaments provided in step (c) without causing said filaments to undergo any permanent stretching, (e) passing said tensioned filaments provided in step (d) between said tension roll and a heated draw roll to draw said tensioned filaments in a single draw step to a draw ratio of between 1.25 and 4.0 and to heat said drawn filaments to a temperature treater than said class transition temperature of said filaments and less than the crystallization temperature thereof, and (f) winding said drawn and heated filaments on a winding device.

2. A method according to claim 1, said polymer chip in step (a) has an intrinsic viscosity of 0.7 to 1.2 and a moisture content of less than 100 ppm.

3. A method according to claim 1, wherein in step (e) said tensioned filaments are passed over said heated draw roll.

4. A yarn produced in accordance with the method of claim 1.

5. A method of producing entangled textured yarn containing poly(trimethylene terephthalate) filaments for use in fabricating carpeting and pile fabrics which comprises the steps of:

(a) feeding poly(trimethylene terephthalate) polymer chip to a melt extrusion apparatus wherein said polymer is melted, mixed and extruded through a spinneret to form filaments, (b) cooling said filaments formed in step (a) using air flowing perpendicularly to the movement of said filaments, (c) coating the cooled filaments provided in step (b) to form coated filaments, (d) passing said coated filaments between an unheated feed roll and a tension roll so as to tension said coated filaments provided in step (c) without causing said filaments to undergo any permanent stretching, (e) passing said tensioned filaments provided in step (d) between said tension roll and a heated draw roll to draw said tensioned filaments in a single draw step to a draw ratio of between 1.25 and 4.0 and to heat said drawn filaments to a temperature greater than said glass transition temperature of said filaments and less than the crystallization temperature thereof, (f) winding said drawn and heated filaments on a winding device, (g) texturing the drawn and heated filaments in a mechanical crimp texturing unit, and (h) entangling said textured filaments to produce said entangled textured yarn.

6. A method according to claim 5, wherein said polymer chip in step (a) has an intrinsic viscosity of 0.7 to 1.2 and a moisture content of less than 100 ppm.

7. A method according to claim 5, wherein in step (e) said tensioned filaments are passed over said heated draw roll.

8. An entangled textured yarn produced in accordance with the method of claim 5.

9. A carpet made with entangled textured yarn produced in accordance with claim 5.

10. A woven floor covering made with entangled texture yarn produced in accordance with claim 5.

* * * * *